US005531209A

United States Patent [19]

Liedtke

[11] Patent Number: 5,531,209

[45] Date of Patent: Jul. 2, 1996

[54] COMPOUND SLINGSHOT

[76] Inventor: David J. Liedtke, 244 N. First St., Rogers City, Mich. 49779

[21] Appl. No.: 239,900

[22] Filed: May 9, 1994

[51] Int. Cl.[6] ..... F41B 3/02

[52] U.S. Cl. ..... 124/20.1

[58] Field of Search ..... 124/20.1, 20.2, 124/20.3, 21, 22, 25.6

[56] References Cited

U.S. PATENT DOCUMENTS 1,153,415 9/1915 Beaty ..... 124/20.1 X
4,169,453 10/1979 Hunsicker ..... 124/22 X
4,411,248 10/1983 Kivenson ..... 124/20.1
4,651,707 3/1987 Bozek ..... 124/20.1 X
4,703,744 11/1987 Taylor et al. ..... 124/20.1
4,911,136 3/1990 Brown ..... 124/20.1

*Primary Examiner*—Eric K. Nicholson
*Assistant Examiner*—John A. Ricci
*Attorney, Agent, or Firm*—Michael I. Kroll

[57] ABSTRACT

A compound slingshot is provided, which consists of a weapon operated by manual energy, to propel a small missile towards a target. A structure is coupled to the weapon, for increasing the speed of the small missile towards the target, by using less manual energy by applying tension to the bowstring of the speed increasing structure so that an elastic band with a pouch will propel the small missile.

9 Claims, 2 Drawing Sheets

COMPOUND SLINGSHOT

BACKGROUND OF THE INVENTION

1. Field of the Invention

The instant invention relates generally to projectile weapons and more specifically it relates to a compound slingshot.

2. Description of the Prior Art

Numerous projectile weapons have been provided in prior art that are adapted to hurl missiles by external forces at targets remotely located therefrom. While these units may be suitable for the particular purpose to which they address, they would not be as suitable for the purposes of the present invention as heretofore described.

SUMMARY OF THE INVENTION

A primary object of the present invention is to provide a compound slingshot that will overcome the shortcomings of the prior art devices.

Another object is to provide a compound slingshot that incorporates both the action of a compound bow and a slingshot in one unit by connecting an elastic band of the slingshot with a bowstring.

An additional object is to provide a compound slingshot that has increased power and a breaking point in the amount of pull it takes to achieve full power.

A further object is to provide a compound slingshot that is simple and easy to use.

A still further object is to provide a compound slingshot that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 2:
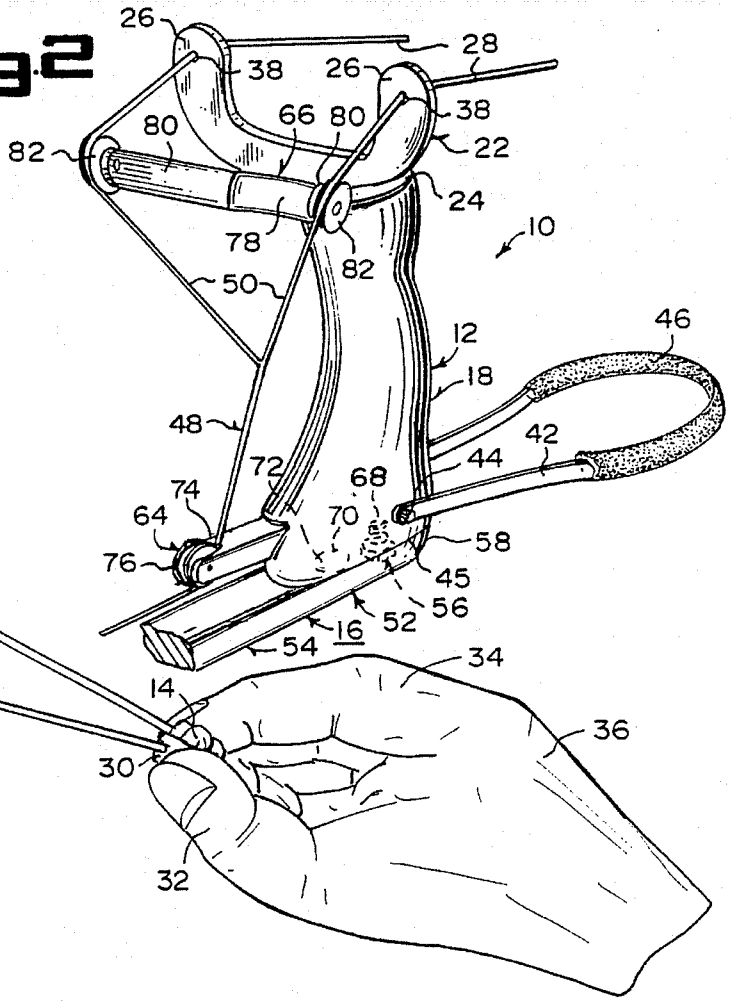
FIG. 2 is a front perspective view taken in the direction of arrow 2 in FIG. 1.
Figure 1:
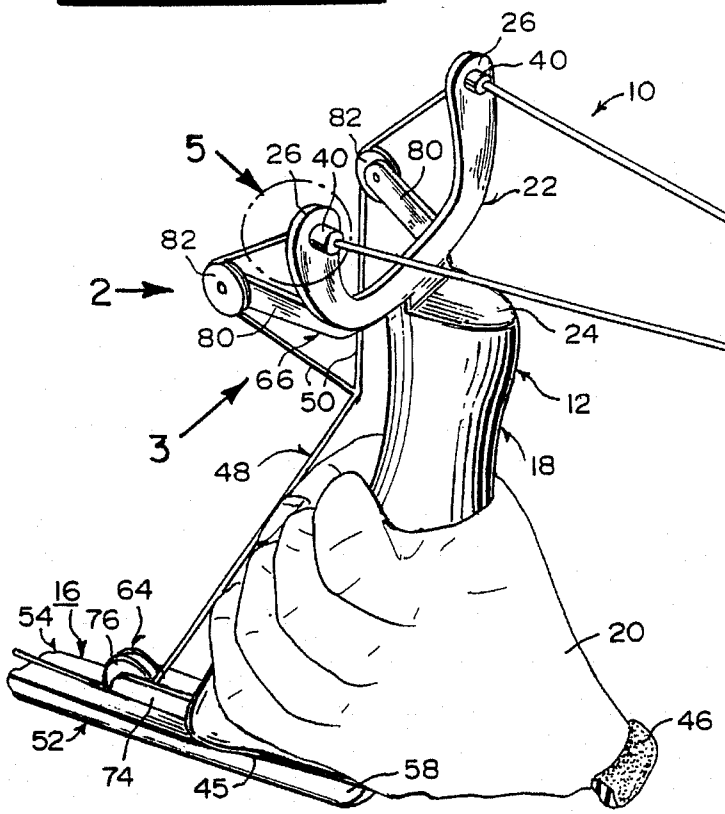
FIG. 1 is a rear perspective view of the instant invention with parts broken away being used.

Turning now descriptively to the drawings, in which similar reference characters denote similar elements throughout the several views, FIGS. 1 through 5 illustrate a compound slingshot 10, which consists of a weapon 12 operated by manual energy, to propel a small missile 14 towards a target. A structure 16 is coupled to the weapon 12, for increasing the speed of the small missile 14 towards the target by using less manual energy.

The weapon 12 includes a handle 18, to be gripped by a first hand 20 of a person. A fork 22 is on a top end 24 of the handle 18 and has two spaced apart upstanding prongs 26. An elastic band 28 extends rearwardly from the prongs 26. A pouch 30 is centered on the elastic band 28 opposite from the prongs 26, for holding the small missile 14 to be propelled therefrom. A thumb 32 and an index finger 34 of a second hand 36 of the person engages the pouch 30 and the small missile 14, so as to pull back the elastic band 28 and then release the pouch 30, to propel the small missile 14 towards the target.

Each prong 26 has an aperture 38. A pair of sleeves 40 are provided, with each extending rearwardly from one aperture 38 in one prong, to allow the elastic band to slide therethrough when pulled back.

The compound slingshot 10 further contains a wrist strap 42 and a pair of fasteners 44, for attaching two ends of the wrist strap 42 to opposite sides of the handle 18 adjacent a bottom end 45. The wrist strap 42 will extend rearwardly from the handle 18, to wrap about the wrist of the first hand 20, so as to better stabilize the weapon when being gripped by the first hand 20. The wrist strap 42 contains a padded portion 46, which will contact and cushion the wrist of the first hand 20.

The speed increasing structure includes a bowstring 48, having a Y-shape configuration at a first end 50, to integrally connect to the ends of the elastic band 28 of the weapon 12. A facility 52 is provided for applying tension to the bowstring 48, so that the elastic band 28 with the pouch 30 will propel the small missile 14 to a grater distance towards the target.

Figure 3:
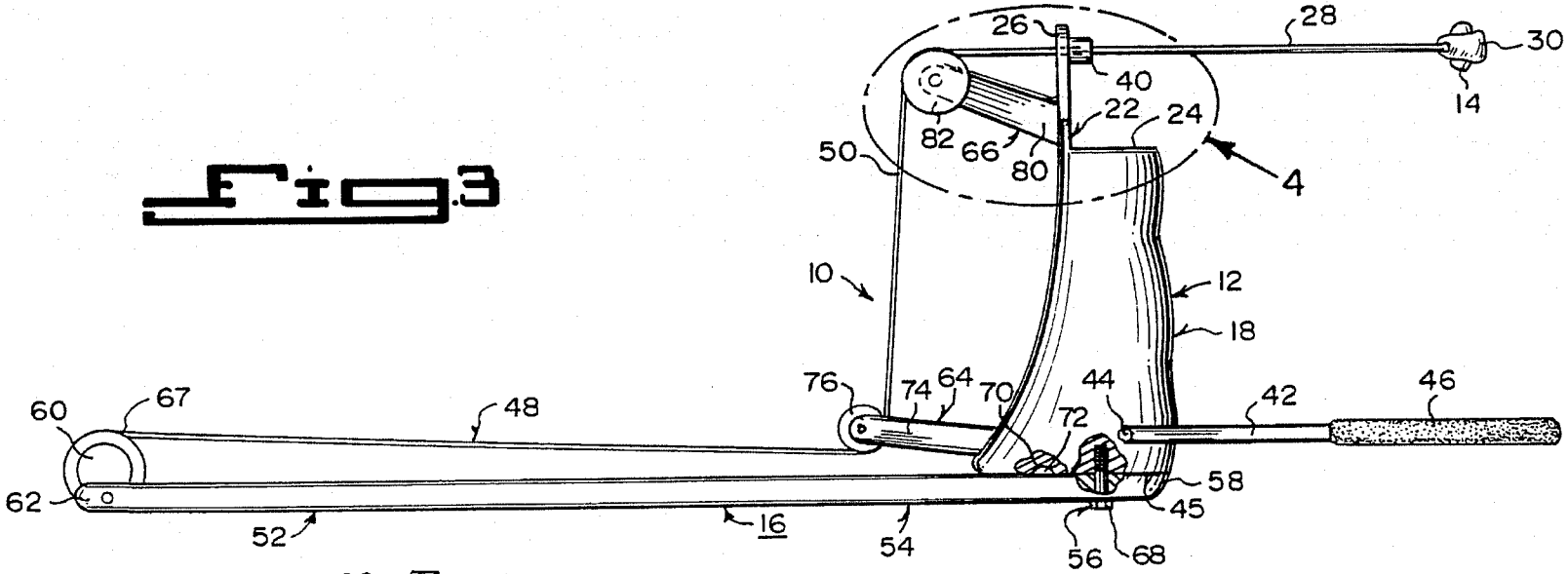
FIG. 3 is a side view taken in the direction of arrow 3 in FIG. 1, showing the complete unit.
Figure 5:
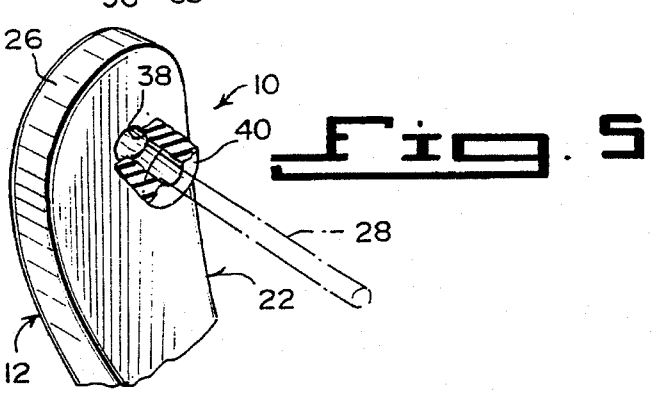
FIG. 5 is an enlarged perspective view of a portion thereof as indicated by arrow 5 in FIG. 1, with parts broken away, in section and in phantom.
Figure 4:
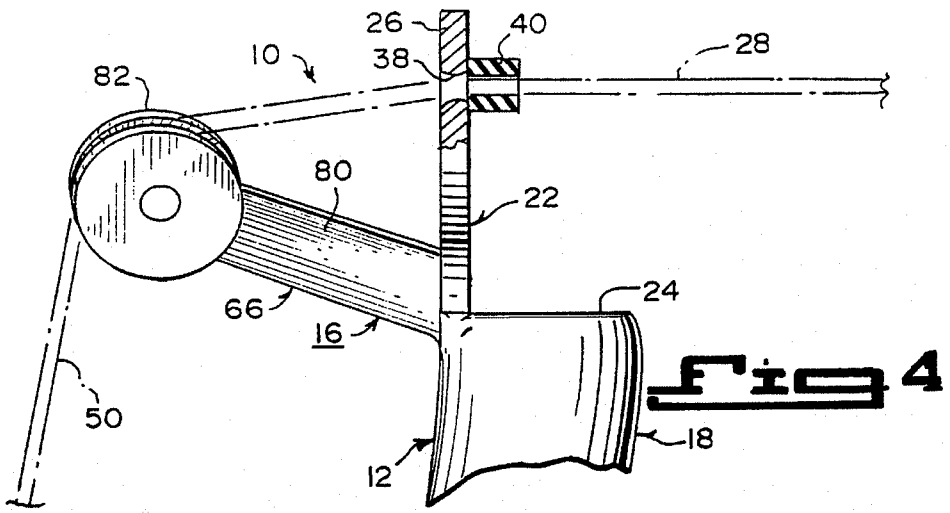
FIG. 4 is an enlarged side view of a portion thereof as indicated by arrow 4 in FIG. 3, with parts broken away, in section and in phantom.

The tension applying facility 52 consists of an elongated limb 54. An element 56 is for connecting a first end 58 of the limb 54 to the bottom end 45 of the handle 18, so that the limb 54 will extend forwardly from the handle 18 in a generally horizontal position. An eccentric cam pulley 60, shown in FIG. 3, is mounted onto a second end 62 of the limb 4 opposite from the handle 18. A lower guide assembly 64 is mounted to the handle 18 and extends forwardly therefrom. An upper guide assembly 66 is mounted to the fork 22 and extends forwardly therefrom. A second end 67 of the bowstring 48 will connect to the eccentric cam pulley 60, travel about the lower guide assembly 64, up and over the upper guide assembly 66 and its first end 50 terminating at the ends of the elastic band 28.

The connecting element 56 is a bolt 68, extending transversely through the first end 58 of the limb 54 and is threaded into the bottom end 45 of the handle 18. The handle 18 has an indent 70 in the bottom end 45. The limb 54 has a detent 72 on a top surface adjacent its first end 58. The detent 72 can engage with the indent 70, to maintain the limb 54 in its extended forward position to firmly maintain the limb 54.

The lower guide assembly 64 includes a lower support member 74, extending from a front lower surface of the handle 18 adjacent the bottom end 45. A lower pulley 76 is rotatively affixed to a free end of the lower support member 74, so that the bowstring 48 will travel about the lower pulley 76.

The upper guide assembly 66 contains an upper support member 78, having a pair of arms 80 extending from a front surface of the fork 22. A pair of upper pulleys 82 are provided, with each rotatively affixed to a free end of each arm 80 of the upper support member 78. The first end 50 of the bowstring 48 will go up and over the upper pulleys 82, to the ends of the elastic band 28.

LIST OF REFERENCE NUMBERS

10 compound slingshot
12 weapon
14 small missile
16 speed increasing structure
18 handle
20 first hand
22 fork
24 top end of 18
26 prong of 22
28 elastic band
30 pouch on 28
32 thumb of 36
34 index finger of 36
36 second hand
38 aperture in 26
40 sleeve on 26 at 38
42 wrist strap
44 fastener for 42
45 bottom end of 18
46 padded portion of 42
48 bowstring
50 first end Y-shaped configuration of 48
52 tension applying facility
54 elongated limb
56 connecting element
58 first end of 54
60 eccentric cam pulley
62 second end of 54
64 lower guide assembly
66 upper guide assembly
67 second end of 48
68 bolt for 56
70 indent in 45
72 detent on 54
74 lower support member
76 lower pulley on 74
78 upper support member
80 arm on 78
82 upper pulley on 80

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A compound slingshot which comprises:

a weapon operated by manual energy to propel a small missile towards a target, said weapon including a handle to be gripped by a first hand of a person, a fork on a top end of said handle and having two spaced apart upstanding prongs, an elastic band extending through said prongs and having two ends extending rearwardly from said prongs and connected to a speed increasing means, and a pouch centered on said elastic band opposite from said prongs for holding the small missile to be propelled therefrom, with a thumb and an index finger of a second hand of the person engageable with said pouch and the small missile, so as to pull back said elastic band and then release said pouch to propel the small missile towards the target, each said prong having an aperture and a pair of sleeves, each extending rearwardly from one said aperture in one said prong, to allow said elastic band to slide therethrough when pulled back by said thumb and said index finger.

2. A compound slingshot as recited in claim 1, further including:

a) a wrist strap; and b) a pair of fasteners for attaching two ends of said wrist strap to opposite sides of said handle adjacent a bottom end, so that said wrist strap will extend rearwardly from said handle to wrap about the wrist of the first hand, so as to better stabilize said weapon when being gripped by the first hand.

3. A compound slingshot as recited in claim 2, wherein said wrist strap includes a padded portion, which will contact and cushion the wrist of the first hand.

4. A compound slingshot as recited in claim 3, wherein said speed increasing means includes:

a) a bowstring having a Y-shaped configuration at a first end, to integrally connect to said ends of said elastic band of the weapon; and b) means for applying tension to said bowstring so that said elastic band with said pouch will propel the small missile towards the target.

5. A compound slingshot as recited in claim 4, wherein said tension applying means includes:

a) an elongated limb;

b) means for connecting a first end of said limb to the bottom end of said handler so that said limb will extend forwardly from said handle in a generally horizontal position;

c) an eccentric cam pulley mounted onto a second end of said limb opposite from said handle;

d) a lower guide assembly mounted to said handle and extending forwardly therefrom; and e) an upper guide assembly mounted to said fork and extending forwardly therefrom, so that a second end of said bowstring will connect to said eccentric cam pulley, travel about said lower guide assembly, up and over said upper guide assembly and its first end terminating at the ends of said elastic band.

6. A compound slingshot as recited in claim 5, wherein said connecting means is a bolt, extending transversely through the first end of said limb and threaded into the bottom end of said handle.

7. A compound slingshot as recited in claim 6, further including:

a) said handle having an indent in the bottom end; and b) said limb having a detent on a top surface adjacent the first end, so that said detent can engage with said indent, to maintain said limb in its extended forward position to firmly maintain said limb.

8. A compound slingshot as recited in claim 7, wherein said lower guide assembly includes:

a) a lower support member extending from a front lower surface of said handle adjacent the bottom end; and b) a lower pulley rotatively affixed to a free end of said lower support member, so that said bowstring will travel about said lower pulley.

9. A compound slingshot as recited in claim 8, wherein said upper guide assembly includes:

a) an upper support member having a pair of arms extending from a front surface of said fork; and b) a pair of upper pulleys, each rotatively affixed to a free end of each said arm of said upper support member, so that the first end of said bowstring will go up and over said upper pulleys to the ends of said elastic band.

* * * * *